US006623262B1

(12) United States Patent
McKeithan et al.

(10) Patent No.: US 6,623,262 B1
(45) Date of Patent: Sep. 23, 2003

(54) METHOD OF REDUCING SYSTEM PRESSURE PULSATION FOR POSITIVE DISPLACEMENT PUMPS

(75) Inventors: David B. McKeithan, Waxhaw, NC (US); Bret E. Simoneaux, Harrisburg, NC (US)

(73) Assignee: IMD Industries, Inc., Lawrenceville, NJ (US)

( * ) Notice: Subject to any disclaimer, the term of this patent is extended or adjusted under 35 U.S.C. 154(b) by 0 days.

(21) Appl. No.: 10/072,228

(22) Filed: Feb. 8, 2002

Related U.S. Application Data

(60) Provisional application No. 60/268,110, filed on Feb. 9, 2001.

(51) Int. Cl.[7] ..... F04C 2/16

(52) U.S. Cl. ..... 418/201.1; 418/1; 418/180; 418/197

(58) Field of Search ..... 418/1, 180, 197, 418/201.1

(56) References Cited

U.S. PATENT DOCUMENTS

| | | | | | |
|---|---|---|---|---|---|
| 2,588,888 | A | | 3/1952 | Sennet | 418/197 |
| 2,601,003 | A | | 6/1952 | Pontius | 418/190 |
| 3,103,894 | A | * | 9/1963 | Sennet | 418/197 |
| 3,253,550 | A | * | 5/1966 | Sennet | 418/197 |
| 3,574,488 | A | | 4/1971 | Vanderstegen-Drake | 418/197 |
| 4,233,005 | A | | 11/1980 | Bottoms et al. | 418/190 |
| 4,580,953 | A | * | 4/1986 | Lagerstedt et al. | 418/201.2 |
| 4,773,837 | A | | 9/1988 | Shimomura et al. | 418/180 |
| 5,123,821 | A | | 6/1992 | Willibald et al. | 418/197 |
| 5,350,286 | A | | 9/1994 | Kisi et al. | 418/201.3 |
| 5,934,891 | A | | 8/1999 | Pelto-Huikko | 418/197 |
| 6,033,197 | A | | 3/2000 | Brown et al. | 418/180 |
| 6,042,343 | A | | 3/2000 | Semba et al. | 418/30 |
| 6,042,352 | A | | 3/2000 | Halter et al. | 418/180 |
| 6,082,984 | A | | 7/2000 | Matsumoto et al. | 418/171 |

FOREIGN PATENT DOCUMENTS

| | | |
|---|---|---|
| DE | 4107315 | 9/1991 |

* cited by examiner

*Primary Examiner*—John J. Vrablik
(74) *Attorney, Agent, or Firm*—Dougherty, Clements & Hofer

(57) ABSTRACT

An improved method and apparatus for reducing pressure pulsation when pumping fluids having highly entrained gas therein. The pump has a drive screw and a pair of idler screws. The screws are placed in a screw channel between a suction end and a discharge end. At least one of the clearances between the surfaces of the drive screw, side screw and screw channel is larger in area, from the discharge end to the suction end, than the remaining clearances. The area of the clearance is configured so that sufficient slip flow occurs between the discharge and suction ends to compress the entrained gas in a uniform and controlled fashion so that linear compression occurs throughout the flow path in the pump. Preferably, the clearance is achieved by reducing the outer diameter of the drive screw.

20 Claims, 6 Drawing Sheets

Fig.5
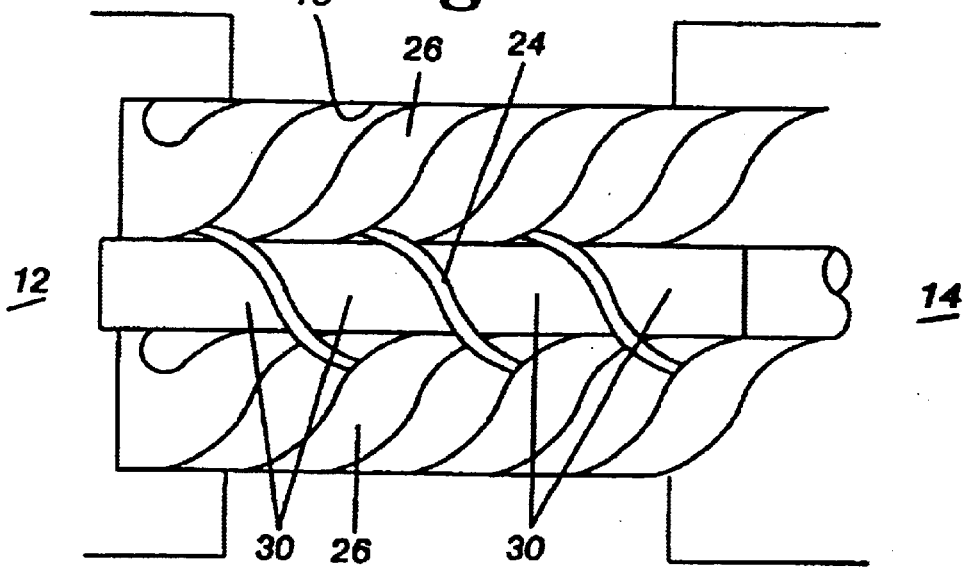
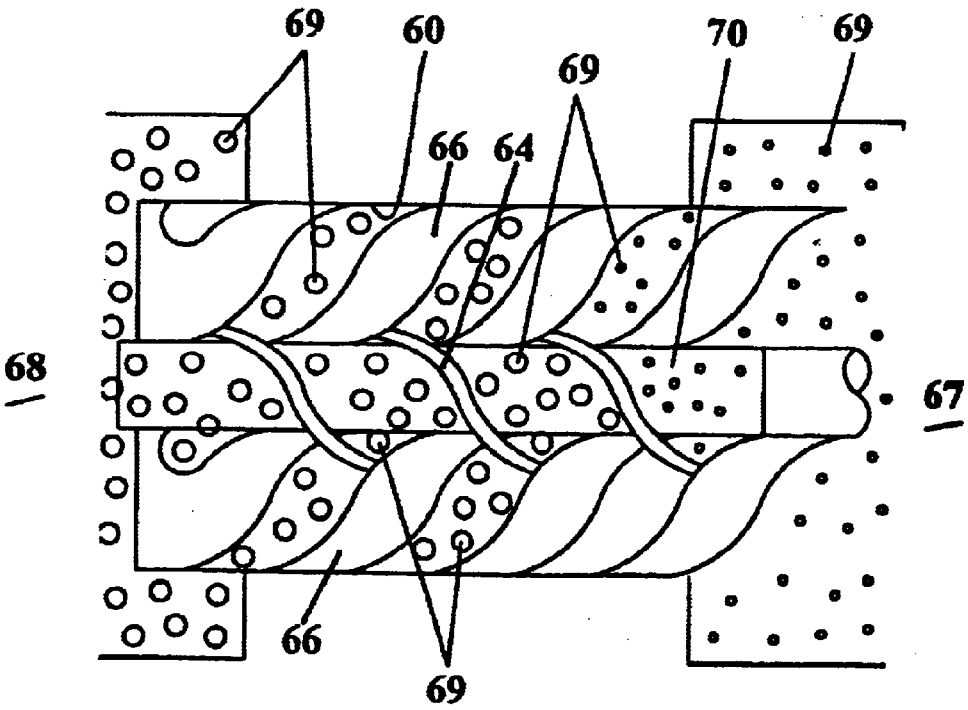
Fig.6
PRIOR ART

METHOD OF REDUCING SYSTEM PRESSURE PULSATION FOR POSITIVE DISPLACEMENT PUMPS

CROSS REFERENCE TO RELATED APPLICATION

This application claims the benefit of U.S. Provisional Application No. 60/268,110, filed Feb. 9, 2001.

FIELD OF THE INVENTION

The present invention relates to a method and apparatus for reducing system pressure pulsation for positive displacement pumps, and more particularly to a method and apparatus for reducing pressure pulsation when pumping fluids having air or other gas highly entrained therein.

BACKGROUND OF THE INVENTION

Screw pumps are positive displacement pumps which deliver a fixed volume of fluid for each rotation of the pump shaft. The configuration and operation of conventional screw pumps are well defined in the art, as briefly summarized below.

Screw pumps deliver a fixed volume of fluid by meshing at least two screws, which are bounded by a tight fitting housing, to create enclosed volumes which carry fluid through the pump. At the inlet of the pump, as the screws rotate, a volume is created and increases in size until at some point of rotation the volume is closed off from the suction end of the pump and becomes a fixed volume. This volume is transported to the discharge end of the pump by further rotation of the screws until the volume breaks into the discharge end of the pump. At this point, the volume is reduced in size by further rotation of the screws, forcing the fluid out of the pump.

These enclosed, fixed volumes are referred to as closures or sealed chambers which exist between the suction and discharge volumes. Screw pumps must have at least one closure, but may have multiple closures to attain higher pressures. When pumping high bulk modulus fluid, that is, fluid with little to no entrained gas, the small amount of leakage, due to manufacturing tolerances between the housing and screws, causes a staging of pressure from suction to discharge. This staging of pressure is fairly linearly distributed in the closures, with the differential between each closure equal to about the value obtained by dividing the discharge pressure by the number of closures plus 1.

As the screws rotate these closures move from suction to discharge, and, at a given point of rotation, the last closure opens into the discharge volume. Since the volume of the last closure is at a lower pressure than the discharge volume and since the fluid being pumped has a high bulk modulus, the combined volume undergoes a sudden decompression. There is a corresponding rebound resulting in positive pressure pulse. As most screw pumps have two thread starts on the screws, there are two closures opening to the discharge volume per revolution of the main screw. Therefore two pressure pulses are delivered per revolution and the primary pulsational frequency of the pump is two times pump speed.

All of existing prior art related to pulsation reduction in screw pumps is intended to reduce this primary pulsation level which causes fluid borne noise. Although this primary pulse is undesirable in certain low noise applications, the level of pressure pulse is not sufficient to cause damage to the pump or associated hydraulic system. Since the level of pulsation is inversely related to the bulk modulus of the fluid, screw pumps are typically utilized with high bulk modulus fluid so that the corresponding magnitude of the pressure pulse is small, typically 1 to 4% of discharge pressure. Additionally, although the associated noise is small, screw pumps are typically applied in applications where low fluid borne noise is a requirement, so there is a continuing effort to reduce this fundamental pulsation level.

U.S. Pat. Nos. 5,123,821 and 5,934,891 deal directly with this problem. U.S. Pat. No. 5,123,821 describes a method for tapering the screws in order to gradually precharge the last closure. It is well understood that precharging the last chamber will reduce primary pulsation pressure and many methods have been employed to accomplish this. U.S. Pat. No. 5,934,891 describes a method that is intended to control variation in the leakage flow within the pump. This is accomplished by utilizing two principles. The first is a controlling of the length of the screws by undercutting the screw diameter on either end of the pump. It is also well known that controlling the length of the screw set so that an exact integer number of closures are formed will minimize pulsation levels. In addition to this, the patent also refers to tapering the ends of the non-drive screws, which will have the same effect as U.S. Pat. No. 5,123,821.

U.S. Pat. Nos. 3,574,488 and 4,773,837 deal with a phenomenon known as cavitation. In this case minute fluid vapor bubbles are introduced at the suction end of the pump and are imploded as they are pressurized in the high pressure area of the pump. These gases exist in the fluid as defined by the laws of partial pressures. It should be noted the quantity of vapor is small and does not significantly change the bulk modulus of the fluid. Therefore, this problem can be solved by methods described above, namely precharging the last closure before it opens to the discharge volume. U.S. Pat. No. 3,574,488 accomplishes this by providing small drillings from the discharge port to the last closure. U.S. Pat. No. 4,773,837 does this by placing circumferential grooves on the driven screws.

Methods for reducing the primary pulsational pressure are generally only effective for a specific set of operating conditions. The magnitude of the reduction is affected by pump speed, fluid viscosity, pressure and standard pump clearances, which vary somewhat during manufacturing. Generally, testing must be performed to establish the feature parameters for a given set of operating conditions and this empirical data is not readily extrapolated to other operating conditions.

U.S. Pat Nos. 2,601,003; 4,233,005; 6,042,352; and 6,033,197 relate to gear pumps and address problems associated with trapped volumes and cavitation. These patents are not related to the problems addressed in this invention.

The prior art discussed above deals with high bulk modulus fluids and the reduction of the primary pulsation pressure which is in the order of 1–4% of discharge pressure. When pumping fluids with highly entrained gas, that is, greater than 2% by volume, the methods taught in the prior art are ineffective. Under these conditions the fluid no longer behaves like a high bulk modulus fluid, but instead becomes a low bulk modulus fluid.

The effect of highly entrained fluids on pressure pulsation is also dramatically different than with high bulk modulus fluids. The entrained air or gas is compressible and is capable or storing large amounts of energy. When the entrained fluid moves from the suction volume towards the discharge area, the normal linear pressure staging is disrupted. There is inadequate leakage flow in the pump to compress the gas sufficiently to permit this staging to occur. Subsequently, the fluid entering the discharge volume is only slightly above inlet pressure and, therefore, the normal pressure decompression is particularly intense.

When pumping these highly entrained fluids, pressure pulsations may reach as much as 400% peak to peak. In extreme cases, the pressure during the decompression interval of the pulse can drop below the vapor pressure of the fluid, and when this occurs the resulting rebound pressure can be extremely high. These high pressure pulses can cause catastrophic damage to the pump or associated hydraulic system.

What is needed is a method and apparatus for pumping fluids having a low bulk modulus. Also needed is for the device to significantly reduce pressure pulsation levels in the pump. Further needed, is for the reduction in pressure pulsation to be accomplished in a controlled predictable manner.

DESCRIPTION OF THE PRIOR ART

Applicant is aware of the following U.S. Patents concerning positive displacement pumps.

| U.S. Pat. No. | Issue Date | Inventor | Title |
|---|---|---|---|
| 6,033,197 | 03-07-00 | Brown et al. | GEAR PUMP HAVING A BLEED SLOT CONFIGURATION |
| 5,934,891 | 08-10-99 | Pelto-Huikko | CONSTANT LEAKAGE FLOW, PULSATION FREE SCREW PUMP |
| 5,123,821 | 06-23-92 | Willibald et al. | SCREW SPINDLE PUMP WITH A REDUCED PULSATION EFFECT |
| 4,773,837 | 09-27-88 | Shimomura et al. | SCREW PUMP |
| 4,223,005 | 11-11-80 | Bottoms et al. | HYDRAULIC GEAR PUMP WITH RECESSES IN NON-WORKING GEAR FLANKS |
| 3,574,488 | 04-13-71 | Vanderstegen-Drake | SCREW PUMPS |
| 2,601,003 | 06-17-52 | Pontius | GEAR PUMP |

SUMMARY OF THE INVENTION

The present invention is a screw pump for pumping fluids highly entrained with gas. During operation, the inventive screw pump greatly reduces pressure pulsation in the screw pump by providing sufficient slip flow from the discharge end to the suction end. The slip flow compresses the entrained gas throughout the flow path of the pump so that the fluid pressure increases in a generally linear fashion as the fluid is conveyed from the suction end to the discharge end.

In the broadest sense, the screw pump includes a screw housing having a chamber with axially spaced inlet and outlet ends. A rotary threaded screw is positioned within the housing to convey fluid from the inlet end to the outlet end. A slip path extends between the ends to convey fluid from the outlet end to the inlet end.

Also in the broadest sense, the screw pump comprises a pump casing having a suction end, a discharge end, and a screw channel there-between. The screw channel includes a first bore and a second bore juxtaposed with the first bore. A drive screw and an idler screw are mateingly engaged and are respectively rotatably disposed within the first bore and the second bore. At least one of the clearances between the surfaces of the drive screw, idler screw and screw channel is larger than the remaining clearances and define a slip path extending from the discharge end to the suction end. Slip flow occurs within the slip path from the discharge end to the suction end. Optionally, the slip path can be disposed between the outer diameter of the drive screw and a wall of the first bore. In another option, the slip flow has a flow rate of about eight percent (8%), or more, of the pump's through-flow rate.

Additionally in the broadest sense, a method of reducing pressure pulsation in a pump is provided. This method includes providing a pump having a casing with a suction end, a discharge end, and a screw channel there-between. The screw channel includes a first bore and a second bore juxtaposed with the first bore. A drive screw and an idler screw are mateingly engaged and are respectively rotatably disposed within the first bore and the second bore. At least one of the clearances between the surfaces of the drive screw, idler screw and screw channel is larger than the remaining clearances and define a slip path extending from the discharge end to the suction end. Fluid is provided at the suction end and then conveyed through the screw channel to the discharge end. Slip flow is conveyed within the slip path from the discharge end to the suction end. Optionally, the fluid pressure can be generally linearly increased as the fluid is conveyed from the suction end to the discharge end.

OBJECTS OF THE INVENTION

The principal object of the present invention is to provide a method and apparatus for reducing pressure pulsation in pumps.

A further object of this invention is to provide an apparatus for reducing pressure pulsation in low bulk modulus fluids.

Another object of the invention is to provide an apparatus which reduces vibrations in pumps.

A further object of this invention is to provide and apparatus which reduces fluid borne noise in pumps.

Another object of this invention is to provide an apparatus which has controlled slip flow from its discharge end to its suction end.

A further object of this invention is to provide an apparatus which uniformly and in a controlled fashion compresses entrained air as the fluid is carried through the pump.

Another object of the present invention is to provide an apparatus which provides linear compression of entrained air throughout the flow path in the pump.

BRIEF DESCRIPTION OF THE DRAWINGS

The foregoing and other objects will become more readily apparent by referring to the following detailed description and the appended drawings in which:

FIG. 5 is a schematic, longitudinal cross-section of the screw channel having fluid with little to no entrained gas;

FIG. 6 is a schematic, longitudinal cross-section of a prior art screw channel having fluid with highly entrained gas;

DETAILED DESCRIPTION

The present invention is a screw pump for pumping fluids, and specifically for pumping low bulk modulus fluids and/or fluids with highly entrained gas. Highly entrained fluids are fluids with at least 2% entrained gas by volume. In typical applications, the invented pump will be used for fluids having an entrainment in the range of 2–15%. In particular, the screw pump has a continuous slip path that allows sufficient slip flow to substantially reduced pressure pulsations when pumping low bulk modulus fluids. The slip flow is provided from discharge end to suction end to compress the entrained gas in a uniform and controlled fashion throughout the flow path of the pump.

Figure 1:
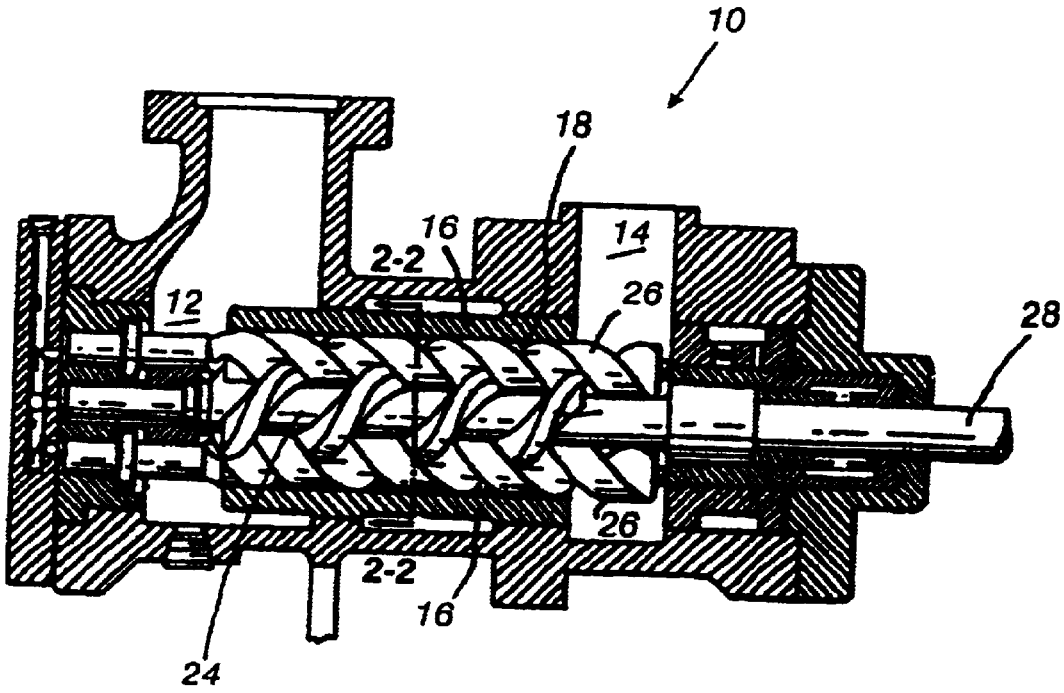
FIG. 1 is a cross-section of a screw pump.
Figure 2:
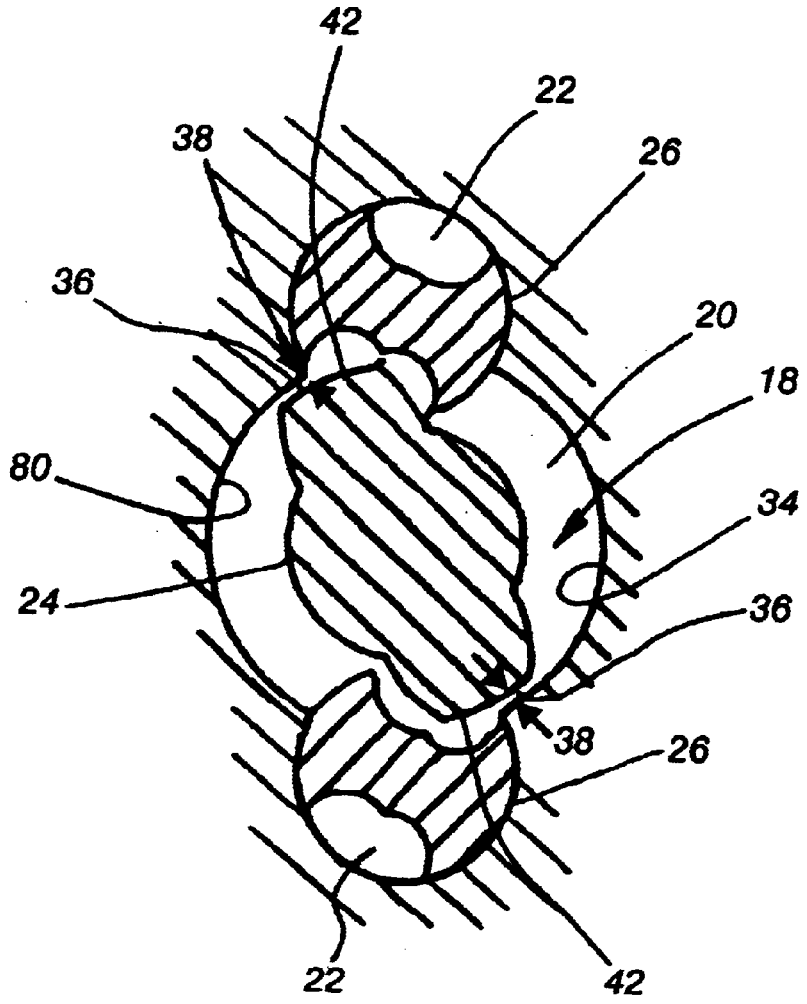
FIG. 2 is a transverse section taken on the plane indicated at 2—2 in FIG. 1, showing a slip path in accordance with the present invention.

Referring now to the drawings, FIG. 1 is a schematic cross-section of a screw pump 10. The pump 10 includes an inlet-suction end 12, an outlet-discharge end 14, and a casing 16 defining a screw channel 18 there-between. As illustrated in FIG. 2, the screw channel 18 comprises a larger center bore 20 and a pair of smaller bores 22 juxtaposed on opposed sides of the center bore 20, for respectively receiving a drive screw 24 and a pair of idler screws 26. Operating power for the drive screw 24 is transmitted by means of a drive screw spindle 28 (FIG. 1), which is rotated by an electric motor or other drive unit (not shown). In the schematic pump 10 shown in FIG. 1, fluid is conveyed from left to right.

Although a screw pump 10 is illustrated and used as a foundation for discussion, it will be appreciated by those skilled in the art that the invention that the following disclosure is applicable to a wide variety of screw pumps as well as external and internal gear pumps.

Figure 3:
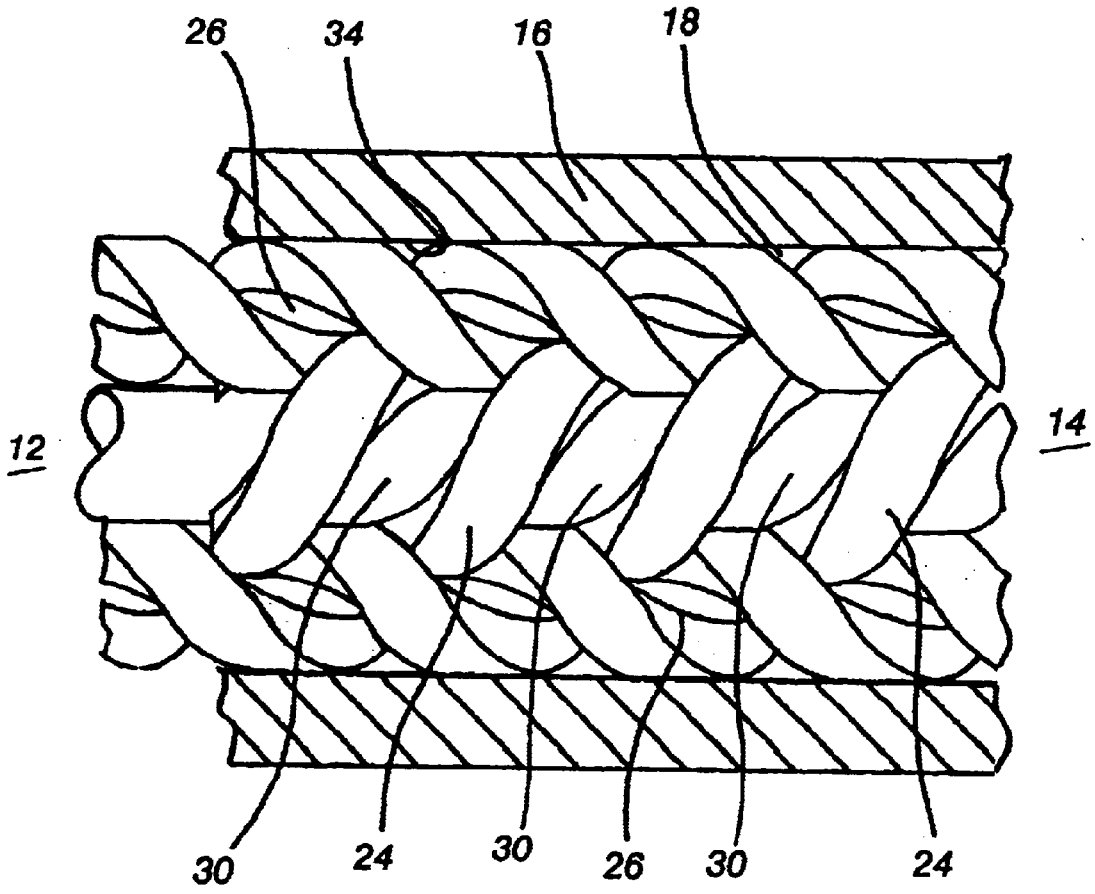
FIG. 3 is a fragmented, longitudinal cross-section of a screw channel having screws in accordance with the present invention.

FIG. 3 illustrates a fragmented, longitudinal section of the screw channel 18, drive screw 24 and idler screws 26. A series of closures 30 are axially spaced along the length of the screws, formed between successive turns of the screw threads and the screw channel wall 34. As the screws 24, 26 are rotated, the closures 30 are moved from the low pressure, suction end 12 to the high pressure, discharge end 14, into which they open.

One or more clearances between the drive screw 24, idler screws 26 and screw channel wall 34 is enlarged to create the continuous slip path 36 (FIG. 2) from the discharge end 14 to the suction end 12. FIG. 2 illustrates the option of providing the clearance 38 between the crest 42 of drive screw 24 and screw channel wall 34. This clearance 38 provides a constant area path for fluid to pass from one closure to the proceeding closure until each closure is affected so that entrained gas is compressed in a uniform and controlled fashion. As a result, the slip flow causes of the pressure to increase in a generally linear fashion in relation to the closure 30 advancement (illustrated in FIG. 3) throughout the screw channel 18. Accordingly, there is no severe decompression interval or associated high-pressure pulse. By "generally linear", it is meant that the pressure differential between each closure 30 is equal to approximately the value obtained by dividing the discharge pressure by the number of closures plus one. This definition further incorporates the fact that the equation is an approximation since the pressure differential is a result of a dynamic condition which changes as a function of rotation and is affected by how long the closure exists when the number of closures is not an exact integer.

In more detail, the clearance 38, which defines the slip path 36, is the distance between the screw channel wall 34 and the screw crest of at least one of the screws 24, 26 so that the channel wall 34 is radially spaced from the respective screw. The clearance 38 can be effectuated by either enlarging the appropriate screw channel bore 20, 22 or reducing the screw outer diameter by reducing the height of the screw thread. Nevertheless, for manufacturing and operational considerations, it is preferable to increase the clearance 38 between the screw channel wall 34 and the crest 42 of the drive screw 24 by decreasing the screw thread height, as illustrated in FIG. 2. It is noted that the cross-sectional area of the slip path between the screw channel wall 34 and the screw crest 42 is substantially constant throughout the pump between the discharge end 14 and the suction end 12.

Figure 4:
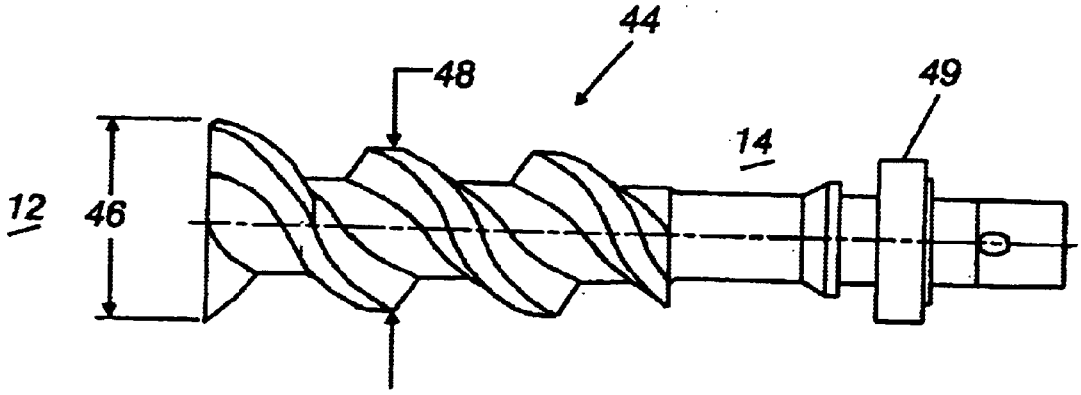
FIG. 4 is a longitudinal cross-section of a variant drive screw having a nominal diameter at a suction end of the pump and a reduced diameter extending from the suction end to a discharge end.

FIG. 4 shows a variant drive screw 44 (the idler screws and screw channel are as previously described and are not shown) having a nominal outer diameter 46 at the suction end 12, and a reduced diameter 48 for forming a slip path (not shown) extending from the suction end 12 to the discharge end 14. The nominal outer diameter 46 is disposed such that the first closure (not shown) does not fully seal before partially opening to the slip path and, therefore, doesn't impede slip flow from the discharge end 14 to the suction end 12. The nominal outer diameter 46 acts against the casing to provide bearing support, and with a bearing 49, supports the drive screw 44 against deflection.

The cross-sectional area of the slip path required to cause entrained gas to compress, in a generally linear fashion, between the discharge and suction ends 14, 12, depends on several factors. Included in these are: percentage of entrained gas, fluid viscosity, fluid bulk modulus, flow rate, system stiffness (or rigidity), as well as system component interaction. However, with testing to establish the basic parameters, this data can be interpolated and extrapolated to other operating conditions. Accordingly, due to the generally linear compression throughout the flow path in the pump, engineering of the pump is more predictable than with prior art.

Although the required amount of slip flow will vary according to the above the parameters, for most applications suitable compression is obtained when the slip flow rate is about 8% or more, and preferably from 9–11%, of the pump through-flow rate. It is of note that the amount of slip flow is in addition to normal leakage due to manufacturing tolerances. In general, the higher the percent of entrained gas, the higher the slip rate needed to reduce the pulse. Similarly, the higher the slip rate, the greater the pressure pulsation is reduced for a given gas entrainment level.

Figure 7:
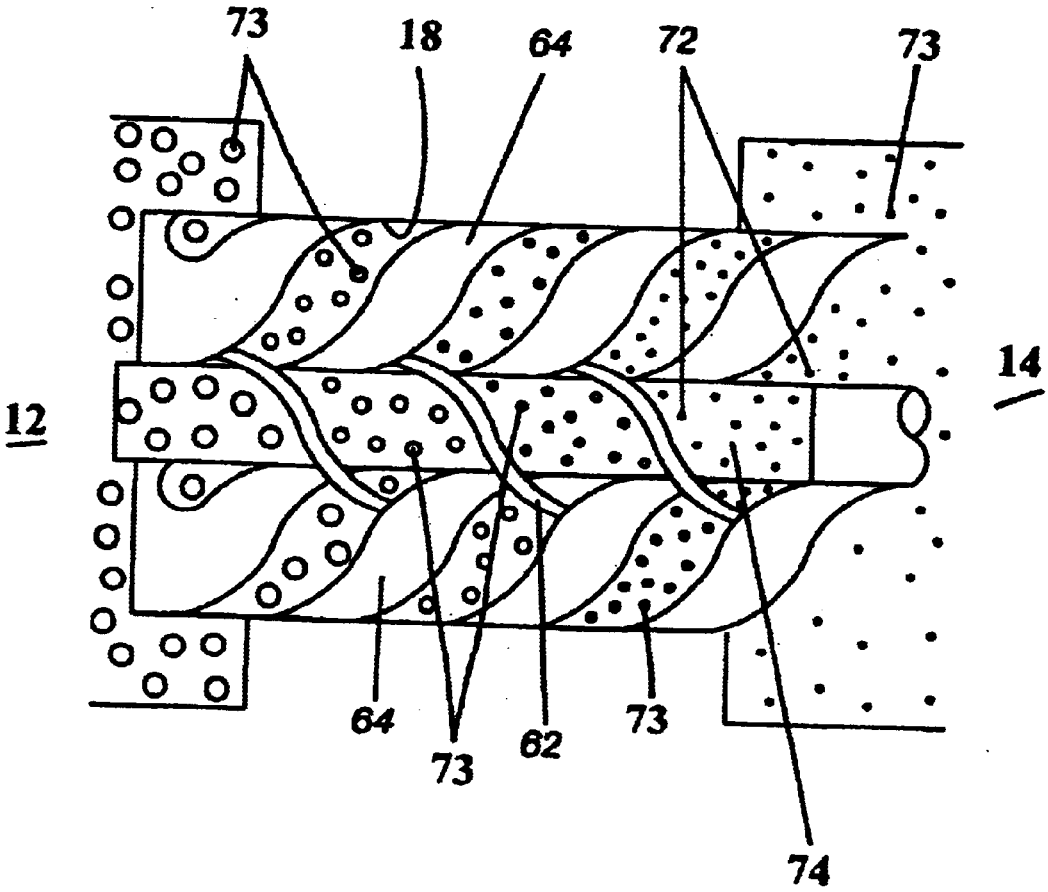
FIG. 7 is a schematic, longitudinal cross-section of the screw channel having fluid with highly entrained gas in accordance with the present invention.

Referring to FIGS. 5–7, the effect of the slip flow is represented in pictorial format. FIG. 5 is a side view of the screw channel 18 with drive and idler screws 24, 26 and having little to no entrained gas in the fluid. For both the prior art and the present invention, pressure increases are staged in a generally linear fashion in the closures 30 as the fluid travels from the suction end 12 to the discharge end 14. Since the fluid has sufficiently increased in pressure before the last closure opens into the discharge end 14, only a minor pressure pulsation in the order of 1–4% of the discharge pressure occurs.

FIG. 6 is a side view of a prior art screw channel 60 with driver and idler screws 64, 66, but without a slip path between the discharge and suction ends 67, 68. When gas 69 (represented by circles) is highly entrained in the fluid, the typical leakage through the pumping elements is not sufficient to compress the gas 69. This is true even if some of the closures, such as the last closure 70, are precharged before opening into the discharge end 67. Accordingly, the normal linear pressure staging is disrupted as the fluid moves from suction end 68 to the discharge end 67. Consequently, when the gas 69 is exposed to the higher pressure discharge end 67, the gas 69 is suddenly compressed and a large pressure pulse results. The sudden compression of entrained gas 69 is pictorially represented by an abrupt decrease in size of the circles in the closure 70 that opens into the discharge end 67.

FIG. 7 is a side view of the screw channel 18 of the present invention, having a slip path 36 (See FIG. 2) extending from the discharge end 14 to suction end 12 and, pumping fluid highly entrained with gas 73 (represented by circles). The slip flow along the slip path is sufficient to compress the gas 73 and, therefore, increase pressure through the pump 10. The highly entrained fluid now acts similar to a high bulk modulus fluid exhibiting a generally linear pressure increase through the pump 10 with an associated generally linear decrease in entrained gas 73 by volume. This linear increase in pressure is pictorially represented by the decreasing size of the circles as the fluid is conveyed from the suction end 12 to the discharge end 14. The increase in pressure obviates sudden compression of the gas 73 as the last closure 74 opens into the discharge end 14. Accordingly, the present invention lowers pressure pulsation to preferably about ≦20%, more preferably ≦15%, and typically from 10–20%, peak-to-peak of the discharge pressure. Although pressure pulsations can be further reduced, but at the expense of efficiency, it is not necessary as this reduction is sufficient to eliminate catastrophic damage to system components. An example of the effectiveness of the present invention on reducing pressure pulsation in a pump is illustrated by FIG. 8, showing the pulsation reduced from 133% peak-to-peak of the discharge pressure to a level of about 20% peak-to-peak, as described below.

Figure 8:
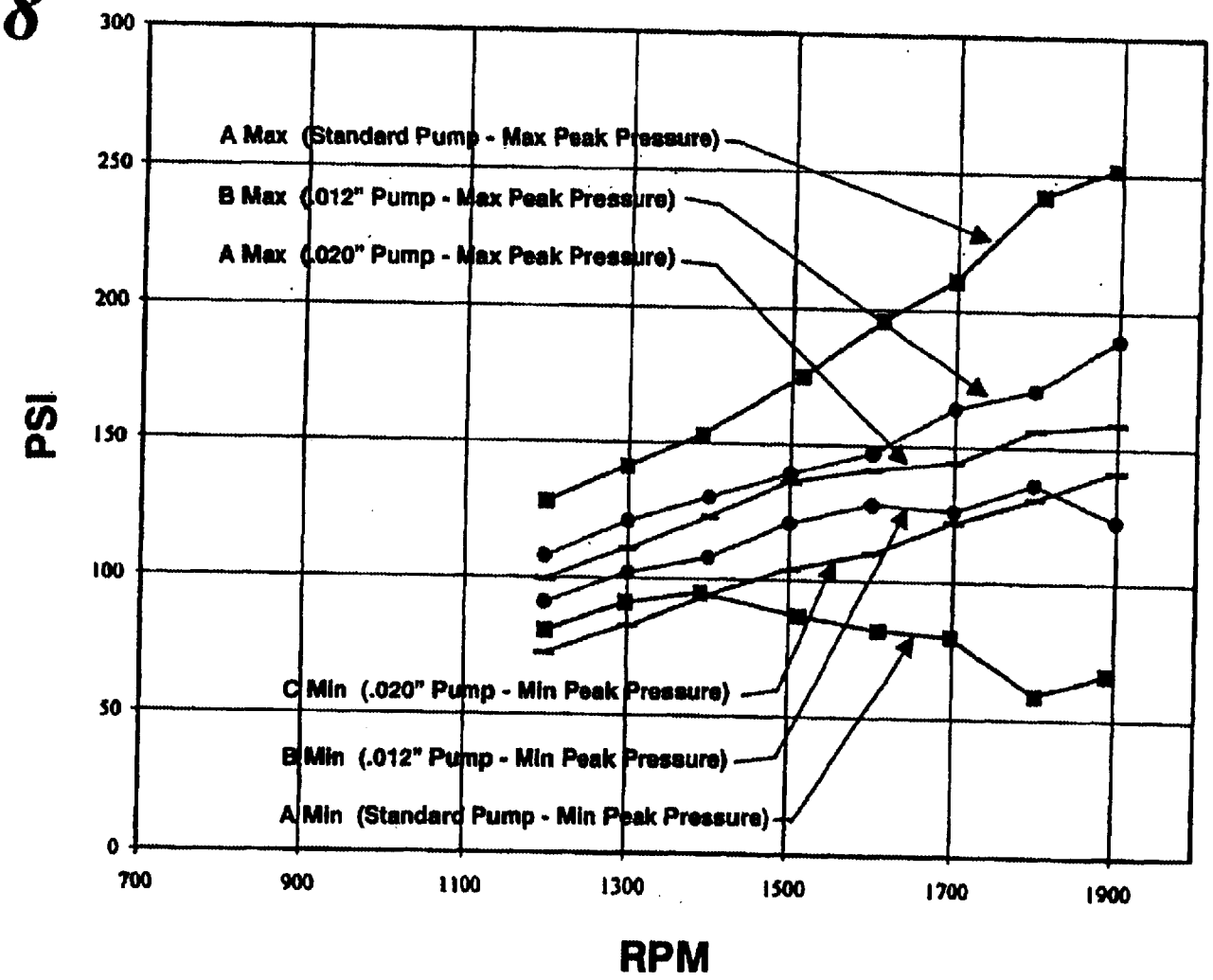
FIG. 8 is a chart comparing pump discharge pressure against pump RPM, and demonstrating pressure pulsation before and after application of the present invention.

The series of curves in FIG. 8 demonstrate the effectiveness of various clearances on reducing the maximum and minimum pressures within a system that is entrained with gas. For each curve, as the pump 10 is operated at increasing speeds more gas is entrained into the fluid. The entrainment level at 1200 rpm is 3–4%, at 1900 rpm is 7–8%, and at 2100 rpm it is 12–15%.

Curves "A max" and "A min" respectively represent maximum pressure and minimum pressure of a prior art pump. The distance between the two lines is the peak-to-peak pressure for the pump. As more gas is entrained in the fluid, the maximum and minimum pressure lines diverge demonstrating that peak-to-peak pressure increases as amount of entrained gas increases. In this example, the pressure pulsation is about 133% of the discharge pressure.

Curves "B max" and "B min" respectively represent maximum and minimum pressures for the present invention utilizing additional diametrical clearance 38 of 0.012 inch (0.006 inch on each side) between the drive screw 24 and the center bore wall 80 (FIG. 2), which provides about a 10% slip flow. The additional diametrical clearance is defined to be the distance between the screw channel wall and the screw crest that is in excess of the normal tolerance therebetween. As the volume of the entrained gas increased, the peak-to-peak pressure remained generally constant due to the slip flow. Specifically, the slip flow allowed the entrained gas to be compressed in a uniform and controlled fashion to provide linear compression throughout the flow path of the pump. Accordingly, pressure pulsation was significantly reduced from that of the prior art pump.

Curves "C max" and "C min" respectively represent maximum and minimum pressures for the present invention utilizing additional diametrical clearance 38 of 0.020 inch (0.010 inch on each side) between the driver screw 24 and the center bore wall 80. The results are similar to that of the 0.012 inch clearance shown by curves "B", except that with increased slip flow the peak-to-peak pressure is reduced further and is even more consistent throughout a range of entrained gas. The pulsations shown by curves "C max" and "C min" represent a pulsation level of about 20% peak-to-peak of the discharge pressure.

Referring to FIG. 3, in use, fluid highly entrained with gas enters the pump 10 through the low-pressure suction end 12 and is forced through the screw channel 18, by the drive and idler screws 24, 26, to the high-pressure discharge end 14. As the screws 24, 26 are rotated, closures 30 containing a volume of fluid move from the suction end 12 to the discharge end 14, into which they open. As the screws 24, 26 deliver fluid to the discharge end 14, some of the fluid returns from the discharge end 14 to the suction end 12 along the continuous slip path 36 (FIG. 2). The returning slip flow passes from one closure to the proceeding closure to compress the entrained gas so that generally linear compression occurs throughout the flow path of the pump 10. As such, a severe decompression interval as well as a high-pressure pulse are avoided.

SUMMARY OF THE ACHIEVEMENT OF THE OBJECTS OF THE INVENTION

From the foregoing, it is readily apparent that we have invented an improved method and apparatus for controlling and reducing pressure pulsation of positive displacement pumps, screw pumps, gear pumps, and the like, than heretofore has been possible. The inventive apparatus is particularly applicable to pumping fluids highly entrained with gas.

It is to be understood that the foregoing description and specific embodiments are merely illustrative of the best mode of the invention and the principles thereof, and that various modifications and additions may be made to the apparatus by those skilled in the art, without departing from the spirit and scope of this invention, which is therefore understood to be limited only by the scope of the appended claims.

What is claimed is:

1. A positive displacement pump for pumping a fluid having highly entrained gas, comprising:

a housing a chamber within said housing and having an inlet end and an outlet end;

a screw positioned within said chamber, said screw having an outer diameter and at least one thread;

a slip path extending from the outlet end to the inlet end; and wherein said slip path is adapted to provide slip flow that is at least eight percent (8%) of a through-flow rate of said pump.

2. The pump according to claim 1 wherein said slip path is adapted to provide slip flow in the range of nine percent (9%) to eleven percent (11%) of a through-flow rate of said pump.

3. The pump according to claim 1 wherein said slip path is disposed between said housing and the outer diameter of said screw.

4. The pump according to claim 3 wherein said slip path exists across the entire width of said at least one thread.

5. A screw pump for pumping a low modulus fluid comprising:

a pump casing having a suction end, a discharge end and a screw channel there-between wherein said screw channel includes a first bore and a second bore juxtaposed with said first bore;

a drive screw rotatably disposed within said first bore;

an idler screw rotatably disposed within said second bore and rotates with said drive screw;

a slip path extending from said discharge end to said end so that a slip flow is conveyed within said slip path from the discharge end to the suction end; and wherein said slip flow has a flow rate of about eight percent (8%), or more, of the through-flow rate of said pump.

6. The pump according to claim 5 wherein the slip flow rate is in the range of nine percent (9%) to eleven percent (11%) of the through-flow rate of the pump.

7. The pump according to claim 5 further comprising a plurality of closures axially spaced along the length of said drive screw, wherein said slip path simultaneously communicates with each of said closures.

8. The pump according to claim 5 wherein a fluid pressure changes generally linearly between said suction end and said discharge end.

9. The pump according to claim 5 wherein said drive screw has a first portion having a first outer diameter that is disposed at said discharge end, and wherein the slip path is disposed between a the first outer diameter of said drive screw and a wall of said first bore.

10. The pump according to claim 9 wherein the entirety of the first outer diameter of said drive screw is spaced from said wall and wherein said slip path is disposed between the first outer diameter and said wall.

11. The pump according to claim 10 wherein said slip path has an arc-shaped cross section.

12. The pump according to claim 9 wherein said drive screw has a second portion having a second outer diameter that is disposed at said suction end, and wherein said second outer diameter is larger than said first outer diameter.

13. The pump according to claim 12 further comprising a plurality of closures axially spaced along the length of said drive screw, wherein said slip path simultaneously communicates with each of said closures, and wherein the closure forming nearest to said suction end does not fully close before at least partially opening to said slip path.

14. A method of reducing pressure pulsation in a pump comprising:

providing a pump having:

a casing having a suction end, a discharge end and a screw channel there-between, wherein said screw channel includes a first bore and a second bore juxtaposed with said first bore;

a drive screw rotatably disposed within said first bore; and an idler screw rotatably disposed within said second bore and engaged with said drive screw;

providing a slip path extending from said discharge end to said suction end;

providing a low bulk modulus fluid at the suction end;

conveying the fluid from said suction end, through said screw channel, to said discharge end, at a throughput rate; and providing a slip flow within said slip path from said discharge end to said suction end, wherein said slip flow has a flow rate of at least eight percent (8%) of the throughput rate.

15. The method according to claim 14 further including the step of generally linearly increasing pressure of the fluid as the fluid is conveyed between said suction end and said discharge end.

16. The method according to claim 14 wherein the fluid provided at the suction end includes at least 2% gas entrainment by volume.

17. The method according to claim 16 further including the steps of providing a plurality of closures axially spaced along the length of said drive screw, wherein the slip flow communicates with each of said closures.

18. The method according to claim 16 further comprising the step of reducing the pressure pulsation to no more than 20 percent peak-to-peak of a discharge pressure of the fluid at the suction end.

19. The method according to claim 16 wherein the gas entrainment is in the range of 4 percent to 15 percent by volume.

20. The method according to claim 19 wherein the gas entrainment is in the range of 8 percent to 15 percent by volume.

* * * * *

UNITED STATES PATENT AND TRADEMARK OFFICE

CERTIFICATE OF CORRECTION

PATENT NO. : 6,623,262 B1
DATED : September 23, 2003
INVENTOR(S) : David B. McKeithan et al.

It is certified that error appears in the above-identified patent and that said Letters Patent is hereby corrected as shown below:

Title page,
Item [73], Assignee, change "IMD Industries, Inc.," to -- IMO Industries, Inc., --

Signed and Sealed this

Thirtieth Day of December, 2003

JAMES E. ROGAN
*Director of the United States Patent and Trademark Office*